United States Patent [19]

Tsuchitani et al.

[11] Patent Number: 4,705,618

[45] Date of Patent: Nov. 10, 1987

[54] PROCESS FOR THE PREPARATION OF AN INTERMEDIATE PITCH FOR MANUFACTURING CARBON PRODUCTS

[75] Inventors: Masatoshi Tsuchitani; Ryoichi Nakajima, both of Ichihara, Japan

[73] Assignee: Maruzen Petrochemical Co., Ltd., Tokyo, Japan

[21] Appl. No.: 849,568

[22] Filed: Apr. 8, 1986

[51] Int. Cl.[4] ..... C10C 3/02; C10C 3/00; D01F 9/12

[52] U.S. Cl. ..... 208/44; 208/40; 264/29.2; 423/447.1; 423/447.2; 423/447.4

[58] Field of Search ..... 208/44, 40

[56] References Cited

U.S. PATENT DOCUMENTS

| | | | |
|---|---|---|---|
| 2,850,436 | 9/1958 | Beuther | 208/40 |
| 3,140,248 | 7/1964 | Bell et al. | 208/40 |
| 4,049,538 | 9/1977 | Hayashi et al. | 208/50 |
| 4,177,133 | 12/1979 | Hayashi et al. | 208/50 |
| 4,472,265 | 9/1984 | Otani | 208/44 |
| 4,518,482 | 5/1985 | Dickakiam | 208/44 |
| 4,522,701 | 6/1985 | Dickakiam | 208/40 |
| 4,528,087 | 7/1985 | Shibatani | 208/44 |
| 4,589,975 | 5/1986 | Yudate | 208/44 |

FOREIGN PATENT DOCUMENTS

| | | |
|---|---|---|
| 0056338 | 7/1982 | European Pat. Off. . |
| 0087749 | 9/1983 | European Pat. Off. . |
| 2169896 | 9/1973 | France . |
| 2303062 | 10/1976 | France . |
| 2396793 | 2/1979 | France . |
| 31483 | 10/1979 | Japan . |
| 160427 | 12/1979 | Japan . |
| 214531 | 12/1983 | Japan . |
| 1645736 | 7/1970 | Netherlands . |

*Primary Examiner*—Paul E. Konopka

*Attorney, Agent, or Firm*—Frishauf, Holtz Goodman & Woodward

[57] ABSTRACT

Until now, it has not yet been succeeded to prepare high performance carbon fibers having satisfactory strength from heavy oils of coal or petroleum origin. We now succeeded to prepare an excellent intermediate pitch which allows the preparation of high performance carbon fibers having tensile strength of higher than 300 $Kg/mm^2$ and Young's modulus of 50 $ton/mm^2$.

The intermediate pitch can be obtained by heating a heavy oil of coal or petroleum origin in a tubular heater under a specific conditions, and then flash distilling the heater effluent in a flash distillation column under a specific condition so as to remove lighter fractions and recovering heavy fraction from the column bottom as the intermediate pitch. The process for the preparation of the intermediate pitch is simple and economical and allows continuous production without fluctuation of quality of the intermediate pitch. The intermediate pitch is also suitable for the production of higher density carbon products.

7 Claims, No Drawings

PROCESS FOR THE PREPARATION OF AN INTERMEDIATE PITCH FOR MANUFACTURING CARBON PRODUCTS

BACKGROUND OF THE INVENTION

1. Field of the Invention

The present invention relates to a simple and economical process for the preparation of an intermediate pitch which is suitable for the production of a variety of carbon products and particularly carbon fibers, from a heavy oil of petroleum or coal origin. More particularly, the present invention relates to a process for a continuous preparation of an intermediate pitch for manufacturing carbon products which comprises heating a heavy oil of a petroleum or coal origin in a tubular heater at a specific pressure, temperature and residence time; transfering the heater effluent to a flash distillation column and conducting flash distillation at a specific pressure and temperature so as to separate lighter fractions from heavy fraction and recovering the heavy fraction as the intermediate pitch.

Carbon products are important as structure materials, and carbon fibers in particular are very important as components of composite materials.

2. Description of the Prior Arts

Carbon fibers have hetherto been produced by carbonization of polyacrylonitrile (PAN) fibers. However, PAN fibers are expensive, the carbonization yields are low, and the carbon fibers produced by this process do not have satisfactory modulus. Attempts to raise their modulus by graphitization by high temperature treatment have been made but, unexpectedly, they resulted in a decreased modulus of the products.

As a result, many processes have been proposed which would allow production of pitches for spinning, which may be convertible to high strength carbon fibers in high carbonization yields, from inexpensive pitches originated from petroleum or coals.

For example, Japanese Patent Disclosure No. 214531/1983 discloses a process for preparing pitches for spinning by hydrogenation and subsequent thermal treatment of raw pitches, and Japanese Patent Disclosure No. 160427/1979 discloses a process for preparing pitches for spinning which comprises isolating isotropic pitches by solvent extraction of raw pitches and then conducting thermal treatment. However, when such processes are applied to raw pitches produced by conventional methods such as distillation, these processes are uneconomical because a large quantity of raw pitches should be treated due to low yields of carbon fibers. Moreover, the strength of the carbon fibers thus produced can not be regarded as sufficiently high: they generally show tensile strengths in the order of 200 Kg/mm$^2$ and Young's modulus of 15–20 ton/mm$^2$.

SUMMARY OF THE INVENTION

We have come to the conclusion that in order to produce excellent or high performance carbon fibers, it is required to produce high quality intermediate pitches which are well suited for this purpose. After an extensive investigation toward establishing a simple and commercially advantageous process which will allow production of high quality intermediate pitches, it was found that substantially isotropic pitches with high benzene insoluble (BI) contents and low quinoline insoluble (QI) contents can be produced by treating heavy oils of coal and petroleum origin in a tubular heater under specific conditions and then conducting high temperature flash distillation under specific conditions so as to remove lighter fractions. It was also found that by the use of the intermediate pitches obtainable by the process of the present invention, spinning pitches with excellent spinning properties can be produced by high yields by the processes such as those disclosed in Japanese Patent Disclosure No. 214531/1983 and Japanese Patent Disclosure No. 160427/1979. Further, it was also found that the carbon fibers produced from the high quality intermediate pitches obtainable by the process of the present invention readily show tensile strength exceeding 300 Kg/mm$^2$ and Young's modulus exceeding 50 ton/mm$^2$. Thus, we have made this invention.

Hence, the main object of the present invention is to provide a process for continuous and stable production of intermediate pitches for manufacturing carbon products from heavy oils of petroleum or coal origin, without fluctuation in their quality, by a simple and commercially advantageous process, and particularly a process for continuous production of high quality intermediate pitches which are suitable for manufacturing carbon fibers.

The second object of the present invention is to provide a simple and economical process for the preparation of pitches well suited for manufacturing high density carbon products, especially high performance carbon fibers.

The third object of the present invention is to provide a commercially valuable process for the preparation of high performance carbon fibers with high tensile strengths and high Young's modulus hetherto not obtained.

Accordingly, the gist of the present invention resides in a process for the continuous preparation of an intermediate pitch for manufacturing carbon products which comprises heating a heavy oil in a tubular heater under a pressure of 4–50 Kg/cm$^2$.G at a temperature of 400°–520° C. with a residence time of 30–1000 sec; transfering the heater effluent to a flash distillation column and conducting a flash distillation under a pressure of 0–3 Kg/cm$^2$.A at a temperature of 380°–520° C. so as to separate lighter fractions as the overhead of said column from heavy fraction and recovering said heavy fraction from the bottom of said column as said intermediate pitch.

THE DETAILED DESCRIPTION OF THE INVENTION

The intermediate pitches produced by the process of the present invention are suitable as the intermediates for the production of carbon fibers, and they may also be used as intermediates of other high density carbon products.

The raw materials which may be used in the present invention are coal-based heavy oils such as coal tars, coal tar pitches and liquefied coals, and petroleum-based heavy oils such as topping residues, vacuum residues, asphalts, cracked residual oils and decant oils. In the specification, they are named as "heavy oils". Among the raw materials described above, coal tars and coal tar pitches are preferable because by the use of such coal-based heavy oils, intermediate pitches with especially high BI contents are produced by the process of the present invention.

Raw material oils with low QI contents are preferred for use in the present invention, and when special raw materials with more than 5 wt % of QI contents are used, it is desirable to reduce the QI contents to below 5 wt % by pre-treatment such as filtration, centrifugation or settling.

According to the process of the present invention for producing intermediate pitches, the raw material heavy oils are heated in a tubular heater under a pressure of 4–50 Kg/cm$^2$.G, preferably 6–30 Kg/cm$^2$.G and more preferably 8–25 Kg/cm$^2$.G, at a temperature of 400°–520° C., preferably 430°–500° C. and more preferably 450°–500° C., for a period of 30–1000 sec, preferably 50–500 sec and more preferably 80–300 sec. Cracking and soaking take place during this treatment. The pressure below 4 Kg/cm$^2$.G of the above-described treatment is not preferred because separation of vapor and liquid phase takes place by evaporation of lighter fractions contained in the raw material heavy oils or lighter fractions formed by cracking of the raw material heavy oils, and remarkably accelerates ready polymerization of the liquid phase. In this case, it gives rise to a remarkable formation of QI fraction and sometimes even deposition of cokes and may result clogging of the heating tubes. Therefore, it is preferred to perform this treatment under a high pressure. However, it is uneconomical to try to maintain the pressure above 50 Kg/cm$^2$.G because it will require a high cost in the construction of the apparatus. It is sufficient that if the pressure can keep the raw material heavy oils in liquid phase almost throughout the whole length of heating tubes.

A treatment temperature below 400° C. is not preferable because sufficient amounts of BI fraction cannot be formed, and the temperature above 520° C. is also not preferable because a large amount of QI fraction is formed and deposition of cokes is increased. When the residence time in the tubular heater is less than 30 sec, only a small amount of BI fraction is formed. When it is more than 1000 sec, a large amount of QI fraction is formed, and at the same time, it is uneconomical because a longer heating tube is generally required, and enhances the risk of clogging of the heating tube.

The term "tubular heater" used herein means a heater equipped with heating tube or tubes. Many kinds of heaters are included within the scope such as electrically heated tubes, tubes kept in a salt bath, a pipe still like a cracking furnace and the like. The term "lighter fractions" means the fractions which can be vaporized in the flash distillation column at the flash distillation conditions specified herein and contain such as cracked gas, cracked gasoline, cracked kerosene, cracked gas oil, cycle oil and the like. The term "heavy fraction" means the fraction which is a liquid under the flash distillation conditions and is usually a solid at a temperature below 100° C.

After the cracking and soaking, the heater effluent, i.e. thermally treated heavy oil is sent to a high temperature flash distillation column, flash distilled under a pressure of 0–3 Kg/cm$^2$.A at a temperature of 380°–520° C., preferably 410°–500° C. and more preferably 430°–500° C.; the lighter fractions are removed from the column top while the heavy fraction, i.e. the intermediate pitch of the present invention is continuously taken out from the column bottom. When flash distillation is performed at a temperature below 380° C., it will give intermediate pitch containing a considerable amount of lighter fractions due to an insufficient flashing off of the lighter fractions which are not preferable as raw materials of carbon fibers. Such pitches containing the lighter fractions are not preferable because, during production of spinning pitches, they require a high treatment cost in such processes as hydrogenation, stripping, or solvent extraction. Temperatures above 520° C. are not preferable because the formation of QI fraction becomes remarkable due to the polymerization during the flash distillation, and pitch withdrawal line may be clogged. As the operating pressure of the flash distillation column, a lower pressure is preferred because the lighter fractions can be sufficiently separated from the intermediate pitch even at a low temperature. The flashing efficiency is lowered as the operating pressure is increased, and it is necessary to raise the temperature of the flash distillation column, and this may cause problems such as the formation of cakes. Thus, the pressure of the flash distillation column should be maintained between 0–3 Kg/cm$^2$.A, preferably between 0–2 Kg/cm$^2$.A and more preferably between 0.3–1.5 Kg/cm$^2$.A.

The intermediate pitches thus produced by the process of the present invention generally contain more than 50 wt % of BI fraction, less than 30 wt % of QI fraction and more than 40 wt % of $\beta$-resins, and they usually contain less than 10 wt % of QI fraction, more than 50 wt % of $\beta$-resins and more than 55 wt % of BI fraction. The term "$\beta$-resins" means benzene insoluble, quinoline soluble fraction.

In general, the intermediate pitches produced by the process of the present invention are almost optically isotropic and are substantially homogeneous although they contain a small amount of so called mesophase, i.e. optically anisotropic, components. Nevertheless, since they contain a large amount of BI fraction and $\beta$-resins (BI - QI), they are considerably polymerized pitches having compositions very close to mesophase pitches, and they may readily be converted to mesophase pitches.

The lighter fractions, which are vaporized in the flash distillation column and separated from the heavy fraction, i.e. the intermediate pitch of the present invention, are useful materials and can be used as fuel gas, cracked gasoline, cycle oil, delayed coker feed stock and the like, and should not be regarded as wastes. Especially, the heavier fraction of the vaporized and separated lighter fractions is highly valuable as the starting material for the production of highly crystalline cokes.

In other words, if the detailed differences in the process conditions such as temperature, residence time and pressure in the tubular heater and temperature and pressure of the flash distillation column, are disregarded, the intermediate pitches which are produced by the process of the present invention correspond or nearly correspond to residual oil of a high temperature distillation column in the production of highly crystalline cokes by a delayed coking process known to the art. The residual oil has been regarded as undesirable component in the production of cokes since the residual oil hinders the crystallinity of cokes and induces the formation of undesirable amorphous cokes (Japanese Patent Publication No. 31483/1979). It is a quite unexpectable fact that the heavy fraction of the present invention which is similar to the residual oil which was, in the past, usually sent to slop or sump tanks, can constitute excellent intermediate pitch for the production of high quality carbon products and especially carbon fibers.

It has not been elucidated yet in detail why the intermediate pitches, which are produced by the process of the present invention and undesirable for the production of cokes, can become excellent raw materials for the production of carbon products and especially carbon fibers. However, while the cokes production is carried out in a short time under severe conditions, on the other hand, during the production of carbon products and especially carbon fibers, the intermediate pitches are slowly converted to a mesophase state under milder conditions and, if required, conducting hydrogenation and stripping of light fractions by bubbling an inert gas stream such as nitrogen, and it may be considered that such processes may enable the orientation and alignment of molecules to take place under such conditions, and during the production of carbon fibers in particular, extrusion from a nozzle hole and subsequent stretching may further enhance the orientation and alignment of molecules.

The intermediate pitches thus produced per se can be used as excellent binder pitches for the production of shaped carbon articles from coke powders. However, to obtain pitches for impregnation of cavities and micropores of carbon products in the production of high density carbon products, it is preferable to improve the quality of the intermediate pitches further by a hydrogenation treatment or an extraction treatment. It is desirable that to conduct impregnation, the pitches have low viscosity. Hydrogenation and extraction treatments are useful to lower the viscosity of pitches. As described below, hydrogenation and extraction treatment of pitches themselves are known to the art relative to the production of carbon fibers and such processes can be used, as per, to the hydrogenation and extraction treatments shown above.

When the intermediate pitches of the present invention are used as raw materials for the preparation of carbon fibers, it is necessary to effectively convert the intermediate pitches produced by the process of the present invention to a mesophase pitch having good spinning properties in order to smoothly produce high strength carbon fibers. Many such processes have been known to the art such as those disclosed in Japanese Patent Disclosure No. 214531/1983 and Japanese Patent Disclosure No. 160427/1979. One desirable treatment is hydrogenation and thermal treatment of the intermediate pitches produced as described above. The hydrogenation may be performed by the use of metal or metal oxide catalysts which are known to the art, but such processes are not so desirable because, for example, the presence of catalyst residues in the pitches should be avoided. It is especially desirable to use a hydrogenated heterocyclic compound such as tetrahydroquinoline as both the hydrogenating agent and solvent for the intermediate pitches of the present invention. Alternatively, hydrogenated polynuclear aromatic compounds such as hydrogenated naphthalene oils, hydrogenated anthracene oils, hydrogenated creosote oils, hydrogenated absorbing oils and the like are also suitable. For example, when tetrahydroquinoline is used as the hydrogenating agent and solvent, the intermediate pitches are readily hydrogenated by heating a mixture of the intermediate pitches of the present invention and tetrahydroquinoline. The hydrogenation is suitably conducted by using 1–3 parts of a hydrogenated heterocylic compound such as tetrahydroquinoline or a hydrogenated polynuclear aromatic compound per 1 part of the intermediate pitches at 380°–480° C., preferably 400°–450° C. under a pressure of 20–50 Kg/cm$^2$.G for 10 min–5 hr, preferably 20 min–3 hr. Elimination of insoluble materials from the hydrogenated products by a process such as filtration and removal of the solvent by distillation afford hydrogenated pitch products. In this process, the use of solid catalysts such as metals or metal oxides is not required and a hydrogenated heterocyclic compound such as tetrahydroquinoline or the hydrogenated polynuclear aromatic compound acts both as the hydrogenating agent and the solvent. Therefore, incorporation of solid catalysts in the pitch products which disturb the microstructures of carbon fibers can be avoided completely.

If desired, the hydrogenation of the intermediate pitch of the present invention can also be conducted by contacting hydrogen gas with a mixture of the intermediate pitch and heterocyclic compounds such as quinoline or polynuclear aromatic compounds such as naphthalene oils, anthracene oils, creosote oils, absorbing oils and the like, in the presence of a metal or metal oxide hydrogenation catalyst. The reaction may be conducted under a hydrogen gas pressure of 50–200 Kg/cm$^2$.G at a reaction temperature of 380–500° C. for 10 min.–10 hr. Under the condition above, heterocyclic compounds or polynuclear aromatic compounds used are easily converted to hydrogenated heterocyclic compounds or hydrogenated polynuclear aromatic compounds.

In order to remove the light fractions which are formed during the hydrogenation treatment and to convert the intermediate pitches to a mesophase state, it is preferable to submit the products to the stripping process at 450°–500° C. for a short time while bubbling of an inert gas stream such as nitrogen, and then convert them gradually to the mesophase at relatively mild conditions at a lower temperature of 400°–450° C. while bubbling of an inert gas stream such as nitrogen.

An alternating procedure to improve the quality of the intermediate pitches of the present invention is a solvent extraction and the extraction may be conducted, for example, by extracting the intermediate pitches with aromatic solvents or mixtures of aromatic solvents and non-aromatic solvents, separating the raffinates from the extracts, and recovering the raffinates as the high quality pitches. The high quality pitches thus obtained by the extraction can readily be converted to mesophase pitches by the stripping and thermal treatments just before described.

The hydrogenation and the solvent extraction are useful to lower the softening point of the pitch. The reason why such treatments can lower the softening point of the pitch is not yet clarified sufficiently. But, at present, we consider that the hydrogenation treatment may result breaking off of side chains or substituents, such as methyl, ethyl, propyl, octyl radicals and the like, from planar pitch molecules, and solvents extraction may result narrowing the molecular weight distribution of the pitch. When preparing carbon fibers by melt spinning, the use of a pitch having low softening point is meritorious since spinning temperature correlates with the softening temperature of the pitch. It is said that at the spinning temperature in general, many organic compounds will decompose, and when degradation and decomposition of pitch are taken into account, it is clear that the use of a pitch having low softening point is advantageous.

Mesophase pitches with good spinning properties can be prepared in high yields when the intermediate pitches produced by the process of the present invention are treated by the methods described above. The carbon fibers produced from the pitches show higher strength than those heretofore produced. Thus, even the present inventors, who are not so familiar with the spinning and fiber carbonization technique, can easily produce fibers with tensile strength in the order of 300 Kg/mm$^2$ and Young's modulus above 50 ton/mm$^2$ either from raw materials of petroleum or coal origin. Needless to say, the process for converting the intermediate pitches of the present invention to mesophase pitches is not restricted to the procedures described above, and any process may be used.

As described above, although the intermediate pitches produced by the present invention are substantially isotropic and homogeneous because they can be converted readily to a mesophase state, spinning pitches with good spinning properties for production of high strength carbon fibers can be produced from these intermediate pitches.

From the viewpoint of manufacturing operation, this process is extremely economical and highly efficient because the pitches for producing high density carbon products and especially, high performance carbon fibers can be produced continuously in a short time by simple operations. For example, if pitches with a comparative quality with those produced by a present invention were to be produced by thermal treatment by a conventional batch process in an autoclave, the pitches should be heated for several hours when the temperature is kept below 450° C. On the other hand, thermal treatment above 450° C., though requiring less time, affords pitch products which are not suitable as the raw materials for manufacture of carbon fibers because QI fraction are formed to a remarkable degree with partial cokes formation. Since very delicate and restricted conditions are required to suppress this cokes formation, it is difficult to prepare high quality pitches in a stable manner without fluctuation of the quality by the conventional batch process, and it is not suitable as a commercial process and is not economical.

On the other hand, the process of the present invention, even under severe conditions with a pressure of 4–50 Kg/cm$^2$.G and a temperature of 400°–520° C., can continuously and stably afford high quality intermediate pitches without cokes formation in a short reaction time, by using simple operations of cracking and soaking in a tubular heater and high temperature flash distillation.

DESCRIPTION OF THE PREFERRED EMBODIMENTS

The present invention is explained materially by the following Examples:

EXAMPLE 1

A coal tar with the properties shown in Table 1 was charged to a heater having a stainless heating tube with an inner diameter of 6 mm, outer diameter of 8 mm and length of 20 m kept in a salt bath, and was submitted to cracking and soaking treatment under a pressure of 20 Kg/cm$^2$.G, at a temperature of 490°C. and with a residence time of 102 sec. The heater effluent was then sent to a high temperature flash distillation column with a diameter of 101.6 mm (4 inches) and a height of 1000 mm, and was flash distilled at a high temperature of 480° C. under atmospheric pressure. The lighter fractions were removed from the column top and the intermediate pitch of the present invention was obtained from the column bottom in a yield of 25.6 wt % based on the coal tar raw material. The intermediate pitch thus obtained had BI contents of 57.6 wt % an QI contents of 4.6 wt % with a softening temperature (ring and ball method) of 157° C., and had fixed carbon contents of 73.7 wt %.

A solution of the intermediate pitch described above in twice the weight of tetrahydroquinoline was charged to an autoclave, and, after complete replacement of the air contained therein with nitrogen, was heated at 410° C. for 60 min under autogeneous pressure. The treated liquid was filtered through a glass filter to remove insoluble materials and the solvent was removed by distillation under a reduced pressure to give a hydrogenated pitch. The hydrogenated pitch (100 g) was charged to a 300 ml polymerization flask and, while bubbling a nitrogen gas stream at a rate of 5 liter/min, it was heated for 10 min in a salt bath kept at 500° C. then for 2.5 hr at 430° C. By this procedure, a spinning pitch with a softening starting temperature of 273° C. was produced. The yield of this pitch was 62.5 wt % based on the intermediate pitch with a softening point of 157° C. described above.

This pitch was spun with a spinning apparatus having a nozzle hole with a diameter of 0.5 mm and a length of 1 mm at a temperature of 370° C. with a spinning rate of 500 m/min, then heated up to 300° C. at a rate of 3° C./min and then kept at this temperature for 30 min in air to afford an infusible fiber. It was thermally treated at 1000° C. and then heated further at 2800° C. in a nitrogen atmosphere to give a graphitized fiber. This fiber has a diameter of 10.6 $\mu$, with a tensile strength of 326 Kg/mm$^2$ and Young's modulus of 57.8 ton/mm$^2$.

Incidentally, the softening starting temperature was determined by heating a long and narrow aluminum plate with a temperature gradient along the length, placing the sample powders along the plate, brushing lightly off the samples and measuring the temperature of the spot where the samples begin to adhere.

Softening starting temperature (°C.)$\approx$Softening temperature by JIS ring and ball method $-20°$ C.

This method was adopted because temperature above 200° C. cannot be measured by JIS ring and ball method.

EXAMPLE 2

A tar by-product from naphtha cracking with the properties shown in Table 1 was charged to the same heater as described in Example 1, and was submitted to cracking and soaking treatment under a pressure of 20 Kg/cm$^2$.G, at a temperature of 480° C. and with a residence time of 151 sec. The effluent was then sent to the same high temperature flash distillation column as described in Example 1, and was flash distilled at a temperature of 470° C. under atmospheric pressure. The lighter fractions were removed from the column top and the intermediate pitch was obtained from the column bottom in a yield of 17.4 wt % based on the naphtha cracking tar raw material. The intermediate pitch thus obtained had BI contents of 64.5 wt %, QI contents of 1.2 wt % and fixed carbon contents of 81.2 wt %, and showed a softening starting temperature of 226° C.

A solution of the intermediate pitch described above was hydrogenated by the same procedure as described in Example 1. The hydrogenated pitch (100 g) was charged to a 300 ml polymerization flask and, while bubbling a nitrogen gas stream at a rate of 5 liter/min, it was heated for 10 min in a salt bath kept at 480° C. then for 45 min at 440° C. By this procedure, a spinning pitch with a softening starting temperature of 281° C. was produced. The yield of this pitch was 65.4 wt % based on the intermediate pitch with a softening starting temperature of 226° C. described above.

This pitch was spun with the same spinning apparatus of Example 1 at a temperature of 375° C., then rendered infusible, carbonized and graphitized to afford a graphitized fiber. This fiber had a diameter of 9.5 μ, with a tensile strength of 316 Kg/mm$^2$ and Young's modulus of 60.8 ton/mm$^2$.

EXAMPLE 3

A tar by-product from gas oil cracking with the properties shown in Table 1 was charged to the same heater as described in Example 1, and was submitted to cracking and soaking treatment under a pressure of 10 Kg/cm$^2$.G, at a temperature of 470° C. and with a residence time of 99 sec. The effluent was then sent to the same high temperature flash distillation column as described in Example 1, and was flash distilled at a temperature of 470° C. under atmospheric pressure. The lighter fractions were removed from the column top and the intermediate pitch was obtained from the column bottom in a yield of 20.3 wt % based on the gas oil cracking tar raw material. The intermediate pitch thus obtained had BI contents of 50.5 wt %, QI contents of 0.8 wt % and fixed carbon contents of 74 wt %, and showed a softening starting temperature of 203° C.

A solution of the intermediate pitch described above in twice the weight of tetrahydroquinoline was charged to an autoclave, and was hydrogenated by heating at 430° C. for 60 min under a nitrogen atmosphere and under autogeneous pressure. After filtration and removal of the solvent, the hydrogenated pitch (100 g) thus produced was charged to a 300 ml polymerization flask and, while bubbling a nitrogen gas stream at a rate of 5 liter/min, it was heated for 45 min in a salt bath kept at 460° C. By this procedure, a spinning pitch with a softening starting temperature of 277° C. was produced. The yield of this pitch was 59.6 wt % based on the intermediate pitch with a softening starting temperature of 203° C. described above.

This pitch was spun with the same spinning apparatus of Example 1 at a temperature of 370° C., then rendered infusible, carbonized and graphatized to afford a graphitized fiber. This fiber had a diameter of 11.4 μ, with a tensile strength of 294 Kg/mm$^2$ and Young's modulus of 53.5 ton/mm$^2$.

TABLE 1

| | Example 1 | Example 2 | Example 3 |
|---|---|---|---|
| raw material | coal tar | naphtha cracking tar | gas oil cracking tar |
| sp. gr. (15/4° C.) | 1.150 | 1.0652 | 1.0172 |
| carbon residue | 19.1 wt % | 13.2 wt % | 19.1 wt % |
| BI fraction | 4.0 wt % | less than 0.1 wt % | less than 0.1 wt % |
| QI fraction | 0.6 wt % | less than 0.1 wt % | less than 0.1 wt % |

We claim:

1. A process for the continuous preparation of an almost optically isotropic and substantially homogeneous intermediate pitch with a benzene isoluble fraction content of more than 50 wt %, a quinoline insoluble fraction content of less than 30 wt % and a beta-resins content of more than 40 wt % for manufacturing a mesophase pitch for preparing carbon fibers which comprises heating a heavy oil having a quinoline insoluble fraction content of less than 5 wt % selected from the group consisting of coal tars, coal tar pitches, tar by-products from naptha cracking, tar by-products from gas oil cracking and decant oils, in a tubular heater under a pressure of 4 to 50 Kg/cm$^2$.G at a temperature of 400° to 520° C. with a residence time of 30 to 1000 sec; transferring the heater effluent to a flash distillation column and conducting flash distillation under a pressure of 0.3 to 1.5 Kg/cm$^2$.A at a temperature of 430° to 500° C. so as to separate lighter fractions as the overhead of said column from a heavy fraction and recovering said heavy fraction from the bottom of said column as said intermediate pitch.

2. The process of claim 1, wherein the conditions for heating in said tubular heater are a pressure of 6 to 30 Kg/cm$^2$.G, a temperature of 430° to 500° C. and a residence time of 50–500 sec.

3. The process of claim 2, wherein the conditions for heating in said tubular heater are a pressure of 8 to 25 Kg/cm$^2$.G, a temperature of 450° to 500° C. and a residence time of 80–300 sec.

4. A process for the preparation of a hydrogenated pitch for manufacturing a mesophase pitch for preparing carbon fibers which comprises heating a heavy oil having quinoline insoluble fraction content of less than 5 wt % selected from the group consisting of coal tars, coal tar pitches, tar by-products from naphtha cracking, tar by-products from gas oil cracking and decant oils in a tubular heater under a pressure of 4 to 50 Kg/cm$^2$.G at a temperature of 400° to 520° C. with a residence time of 30 to 1000 seconds; transferring the heater effluent to a flash distillation column and conducting a flash distillation under a pressure of 0.3 to 1.5 Kg/cm$^2$.A at a temperature of 430° to 500° C. so as to separate lighter fractions as the overhead of said column from a heavy fraction; recovering said heavy fraction from the bottom of said column as an almost isotropic and substantially homogeneous intermediate pitch having a benzene insoluble fraction content of more than 50 wt %, a quinoline insoluble fraction content of less than 30 wt %, and a beta-resins content of more than 40 wt %, hydrogenating said intermediate pitch by using at least one compound selected from the group consisting of tetrahydroquinoline, hydrogenated naphthalene oil, hydrogenated anthracene oil, hydrogenated creosote oil and hydrogenated absorbing oil as a hydrogenating agent and a solvent, in an amount of 1 to 3 parts per 1 part of said intermediate pitch at a temperature of 380° to 480° C., under a presure of 20 to 50 Kg/cm$^2$.G for 10 minutes to 5 hours and removing said hydrogenating agent and lighter fractions formed during the hydrogenation reaction.

5. The process of claim 4, wherein the conditions for heating in said tubular heater are a pressure of 6 to 30 Kg/cm$^2$.G, a temperature of 430° to 500° C. and residence time of 50 to 500 seconds.

6. The process of claim 4, wherein the conditions for heating in said tubular heater are a pressure of 8 to 25 Kg/cm$^2$.G, a temperature of 450° to 500° C. and residence time of 80 to 300 seconds.

7. The process of claim 4, wherein the hydrogenation is conducted at a temperature of 400° to 450° C. for from 20 minutes to 3 hours.

* * * * *